US011187250B2

(12) United States Patent
Gou et al.

(10) Patent No.: US 11,187,250 B2
(45) Date of Patent: Nov. 30, 2021

(54) AUTOMATIC CLEANING DEVICE FOR SUCTION PORT OF ELECTRIC SUBMERSIBLE PUMP

(71) Applicant: SOUTHWEST PETROLEUM UNIVERSITY, Chengdu (CN)

(72) Inventors: Ruyi Gou, Chengdu (CN); Weiyu Chen, Chengdu (CN); Liqiang Zhao, Chengdu (CN); Pingli Liu, Chengdu (CN); Zhifeng Luo, Chengdu (CN); Juan Du, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 17/344,952

(22) Filed: Jun. 11, 2021

(65) Prior Publication Data

US 2021/0301835 A1 Sep. 30, 2021

(30) Foreign Application Priority Data

Jun. 22, 2020 (CN) ..... 202010572087.5

(51) Int. Cl.
*F04D 13/08* (2006.01)
*E21B 37/00* (2006.01)
*F04D 29/70* (2006.01)

(52) U.S. Cl.
CPC ..... *F04D 29/708* (2013.01); *E21B 37/00* (2013.01); *F04D 13/08* (2013.01)

(58) Field of Classification Search
CPC ..... F04D 29/708; F04D 13/08; E21B 37/00
See application file for complete search history.

(56) References Cited

U.S. PATENT DOCUMENTS 5,941,311 A * 8/1999 Newton ..... E21B 43/127 166/369
2016/0040504 A1* 2/2016 Stowe ..... B05B 1/3426 166/312
2016/0040505 A1* 2/2016 Stowe, II ..... B05B 1/34 166/312

* cited by examiner

*Primary Examiner* — Connor J Tremarche

(57) ABSTRACT

The present invention relates to an automatic cleaning device for suction port of electric submersible pump. The pipe string joint is connected between the oil pipe and the electric submersible pump. A plurality of oil drain passage inlets, steel balls, return springs, sealing plugs and oil drain passage outlets are evenly distributed in circumferential direction of a boss. The upper end of the connecting pipe is connected with the outlet of the oil drain passage, and the lower end is connected with the nozzle. The retaining ring secures the connecting pipe on the housing of the electric submersible pump. A high-pressure fluid ejected from the nozzle directly acts on the suction port of the electric submersible pump. The present invention can automatically clean the suction port of the electric submersible pump by relying on the pressure difference between the outlet and the suction port of the electric submersible pump.

1 Claim, 5 Drawing Sheets

AUTOMATIC CLEANING DEVICE FOR SUCTION PORT OF ELECTRIC SUBMERSIBLE PUMP

BACKGROUND OF THE INVENTION

Field of the Invention

The present invention relates to the field of downhole tools for petroleum and natural gas production, in particular to an automatic cleaning device for suction port of electric submersible pump.

Description of Related Art

As a highly efficient and economical mechanical oil production equipment, an electric submersible pump has characteristics of large displacement, large lift range, large production pressure difference, strong adaptability and remarkable economic benefits. With the development of electric submersible pump technology, the electric submersible pump is widely used for oil production on offshore platforms. With the increasing difficulty of oil production on offshore platforms, higher requirements are raised for the suction and pumping performance of electric submersible pump. Especially for the development of heavy oil reservoirs, the viscosity of heavy oil is between 50 Pas and 300 Pas, and the asphaltine and colloid content is too high, resulting in difficult suction of the electric submersible pump.

In addition to crude oil, water and polymers, the downhole fluids also contain other chemicals, such as carbonate and sulfate scales due to a complicated composition. High-viscosity polymers or scales easily result in the suction port plugging of electric submersible pump. If the suction is not smooth, the work will be interrupted.

The suction port of electric submersible pump will be plugged due to sand settling, scaling, paraffinning, polymer and solid phase produced by the formation. As the suction port is considered as the first point for the downhole fluids to enter the oil production equipment, the plugging of suction port will cause the downhole fluids unable to enter the centrifugal pump and to be lifted up to the ground. In serious cases, it may lead to the blocking of pump, the overloading of motor and the stop of electric submersible pump, seriously restricting the efficient application of electric submersible pump and increasing the workover costs.

In order to solve the above problems, physical methods and chemical methods are often used for scale prevention or plug removal in the oil field. The physical methods mainly include mechanical scraping type descaling, annular scale prevention pipe, magnetic scale prevention, precious metal scale prevention, scale prevention by hydraulic switch suction port, and filter screen scale prevention. The chemical methods mainly depend on chemical agents, which are easy to cause secondary damage to the oil reservoir. The existing methods mainly focus on scale prevention and lack the function of scale removal and descaling. In addition, the scale prevention process applied in the oil field has high cost, limited action time and complex mechanical structure. Currently, there is no low-cost and high-efficiency descaling device for the suction port of electric submersible pump.

SUMMARY OF THE INVENTION

The purpose of the present invention is to provide an automatic cleaning device for suction port of electric submersible pump to overcome the shortcomings of prior arts. This device is driven by the electric submersible pump to realize automatic cleaning. Based on the pressure difference between the outlet of electric submersible pump and the suction port, it depends on the water jet and self-excited vibration cavitation effect of the nozzle to effectively realize scale prevention, plug removal and viscosity reduction of suction port and also reduce such risks as shutdown, pump jamming and well failure, etc.

In order to achieve the above purpose, the technical solution used in the present invention is:

An automatic cleaning device for suction port of electric submersible pump includes a pipe string joint, return springs, a connecting pipe, a nozzle, steel balls, sealing plugs and retaining rings.

The pipe string joint is a hollow cylinder, which includes a female thread disposed at an upper end, a boss disposed in a middle part, and a male thread disposed at a lower end; the upper end of the pipe string joint is connected with an oil pipe by threads, while the lower end of the pipe string joint is connected with an outlet of the electric submersible pump by threads; a plurality of oil drain passage inlets, the steel balls, the return springs, the sealing plugs and oil drain passage outlets are evenly distributed in a circumferential direction of the boss.

The boss together with steel balls, the return springs and the sealing plugs constitute check valves; the sealing plugs are connected with the pipe string joint by threads to realize thread sealing; when the pipe string joint is filled with high-pressure fluid, the steel balls compress the return springs to connect the oil drain passage inlets and the oil drain passage outlets; when there is no high-pressure fluid in the pipe string joint, the return springs are extended and reset to push the steel balls, thereby realizing a closure between the oil drain passage inlets and the oil drain passage outlets.

The oil drain passage inlets are connected with an inner wall of the pipe string joint, while the oil drain passage inlets are connected with the connecting pipe; the oil drain passage inlets are disposed in a middle part of the boss of the pipe string joint, while the oil drain passage inlets are disposed below the boss of the pipe string joint and is provided with a female thread.

The connecting pipe is a hollow cylinder, which includes a male thread at an upper end and a female thread at a lower end; the upper end of the connecting pipe is connected with the oil drain passage outlets of the pipe string joint by threads, while the lower end of the connecting pipe is connected with the nozzle by threads.

Each of the retaining rings is a circular ring, which has a plurality of circular holes evenly distributed in a radial direction, an inner wall surface of the retaining ring is fixed with a housing of the electric submersible pump by welding, and the connecting pipe passes through the circular holes of the retaining ring and is fixed by welding; the retaining rings are uniformly welded along an axial direction of the electric submersible pump; the retaining rings secure the connecting pipe on the housing of the electric submersible pump.

An upper end of the nozzle is provided with a male thread, and the upper end of the nozzle is connected with the lower end of the connecting pipe by thread; the nozzle is a self-excited vibration cavitation nozzle, and an internal cavity is divided into a nozzle inlet, a cavitation cavity and a nozzle outlet; the cavitation cavity is eccentric, an included angle between center lines of the cavitation cavity and the nozzle is 5 to 10 degrees; the cavitation cavity is ellipsoid, and a cross section of the nozzle outlet is a wide-angle fan, covering an angle from 100 to 150 degrees.

When the electric submersible pump is working, there is a great pressure difference between the outlet of electric submersible pump and the suction port, usually reaching 10-15 MPa. When the produced high-pressure fluid enters the pipe string joint via the outlet of electric submersible pump, the pressure of the produced high-pressure fluid is greater than the preset pressure of return spring of the check valve. After the check valve is opened and the oil drain passage inlet is connected with the oil drain passage outlet, the produced high-pressure fluid enters the connecting pipe and finally is ejected from the nozzle.

After the produced high-pressure fluid is ejected from the nozzle, it directly acts on the suction port of the electric submersible pump to realize effective plug removal and scale prevention under its jet action, vibration wave and cavitation action. The oscillation and cavitation effects of vibration wave break the medium and long molecular chains of crude oil, reduce the viscosity of crude oil and facilitate the suction of the electric submersible pump, making the electric submersible pump more suitable for heavy oil production.

Due to a significant pressure difference between the outlet of the electric submersible pump and the suction port, as long as the electric submersible pump works normally, part of the produced high-pressure fluid can be ejected from the nozzle to realize real-time automatic cleaning of the suction port. When the electric submersible pump stops, the produced fluid pressure of electric submersible pump drops, and the check valve is automatically closed, so as to avoid the backflow of fluid in the bottom well through the nozzle and the connecting pipe.

The present invention has the following beneficial effects and advantages:

1. The present invention can automatically clean the suction port of the electric submersible pump by relying on the pressure difference between the outlet and the suction port of the electric submersible pump. 2. Depending on the water jet and self-excited vibration cavitation effect of the nozzle, the present invention can effectively reduce the viscosity of heavy oil and realize scale prevention and plug removal. 3. The present invention has the advantages of simple structure, no rotating parts, no need to modify the interior of electric submersible pump, and wide application range.

BRIEF DESCRIPTION OF THE DRAWINGS

Aspects of the present invention are best understood from the following detailed description when read with the accompanying figures. The exemplary embodiments of the present invention and the description thereof are used to explain the present invention, and do not constitute improper limitations on the preset invention. In the drawings.

DESCRIPTION OF THE INVENTION

The present invention is further described by the following drawings and embodiments: The embodiments given are only used to explain the present invention and are not intended to limit the scope of the present invention.

Figure 1:
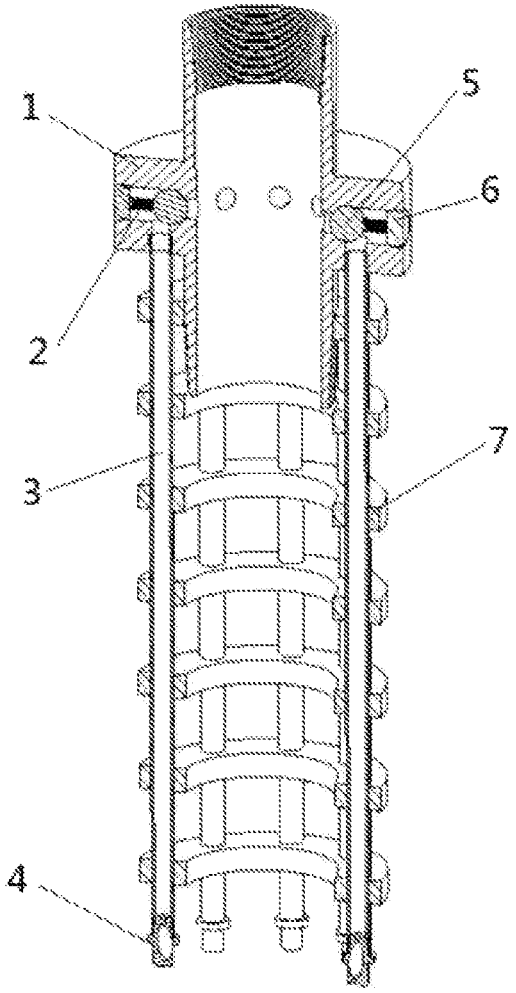
FIG. 1 is a three-dimensional semi-section structure diagram of an automatic cleaning device for suction port of electric submersible pump in the present invention.

As shown in FIG. 1, an automatic cleaning device for suction port of electric submersible pump includes a pipe string joint (1), return springs (2), a connecting pipe (3), a nozzle (4), steel balls (5), sealing plugs (6) and retaining rings (7).

Figure 2:
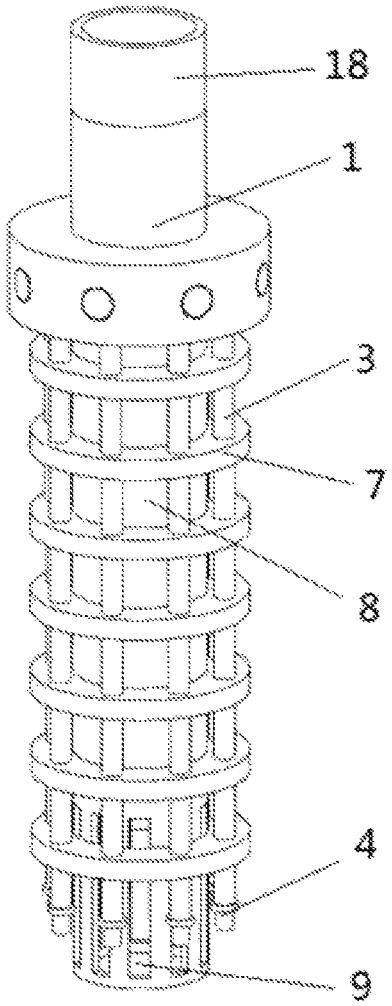
FIG. 2 is a structure diagram of connection between the automatic cleaning device for suction port of electric submersible pump and the electric submersible pump and oil pipe in the present invention.
Figure 3:
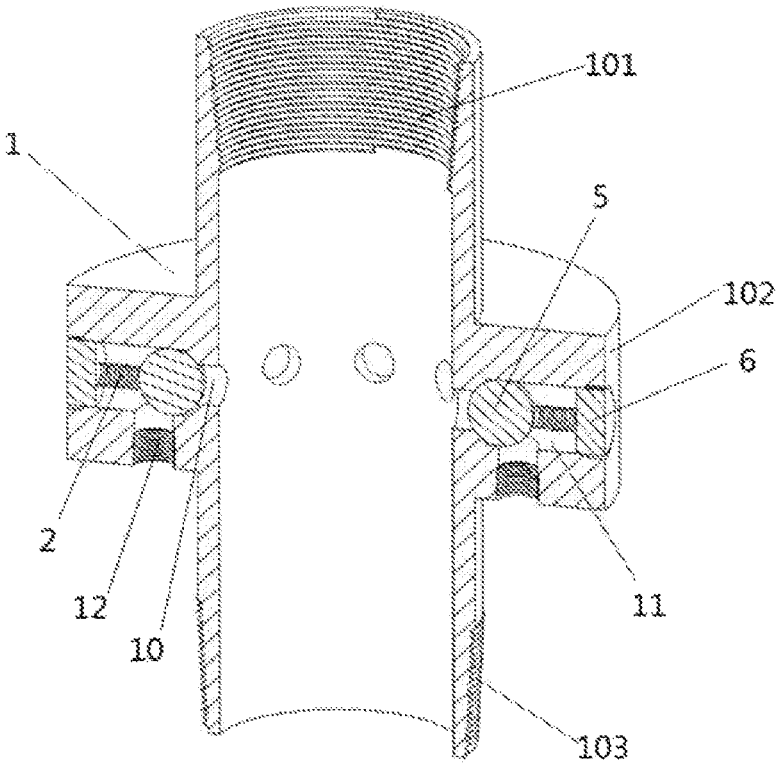
FIG. 3 is a three-dimensional semi-section structure diagram of the pipe string joint in the present invention.

As shown in FIG. 1, FIG. 2 and FIG. 3, the pipe string joint (1) is a hollow cylinder, which includes a female thread (101) at an upper end, a boss (102) in a middle part, and a male thread (103) at a lower end. The upper end of the pipe string joint (1) is connected with an oil pipe (18) by threads, while the lower end is connected with the outlet of the electric submersible pump (8) by threads. A plurality of oil drain passage inlets (10), the steel balls (5), the return springs (2), the sealing plugs (6) and oil drain passage outlets (12) are evenly distributed in a circumferential direction of the boss (102) of the pipe string joint.

As shown in FIG. 3, the boss (102) together with steel balls (5), return springs (2) and sealing plugs (6) constitute check valves (11). The sealing plugs (6) are connected with the pipe string joint (1) by threads to realize thread sealing. When the pipe string joint (1) is filled with high-pressure fluid, the steel balls (5) compress the return springs (2) to connect the oil drain passage inlets (10) and the oil drain passage outlets (12). When there is no high-pressure fluid in the pipe string joint (1), the return springs (2) are extended and reset to push the steel ball (5), thereby realizing the closure between the oil drain passage inlets (10) and the oil drain passage outlets (12).

As shown in FIG. 1 and FIG. 3, the oil drain passage inlets (10) are connected with the inner wall of the pipe string joint (1), while the oil drain passage inlets (12) are connected with the connecting pipe (3). The oil drain passage inlets (10) are disposed in the middle of the boss (102) of the pipe string joint (1), while the oil drain passage inlets (12) are disposed below the boss (102) of the pipe string joint (1) and is provided with a female thread.

As shown in FIG. 1 and FIG. 3, the connecting pipe (3) is a hollow cylinder, which includes a male thread at the upper end and a female thread at the lower end. The upper end of connecting pipe (3) is connected with the oil drain passage outlets (12) of the pipe string joint (1) by threads, while the lower end is connected with the nozzle (4) by threads.

Figure 4:
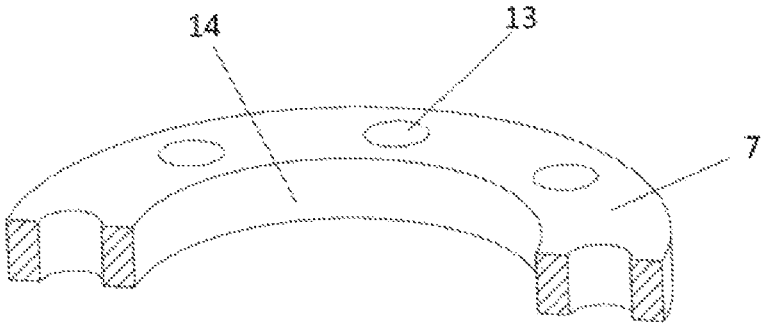
FIG. 4 is a three-dimensional semi-section structure diagram of the retaining ring in the present invention.

As shown in FIG. 2 and FIG. 4, each of the retaining rings (7) is a circular ring, which has a plurality of circular holes (13) evenly distributed in a radial direction. An inner wall surface (14) of the retaining ring (7) is fixed with the housing of the electric submersible pump (8) by welding, and the connecting pipe (3) passes through the circular hole (13) of the retaining ring (7) and is fixed by welding. The plurality of retaining rings (7) are uniformly welded along the axial direction of the electric submersible pump (8). The retaining rings (7) secure the connecting pipe (3) on the housing of the electric submersible pump (8).

Figure 5:
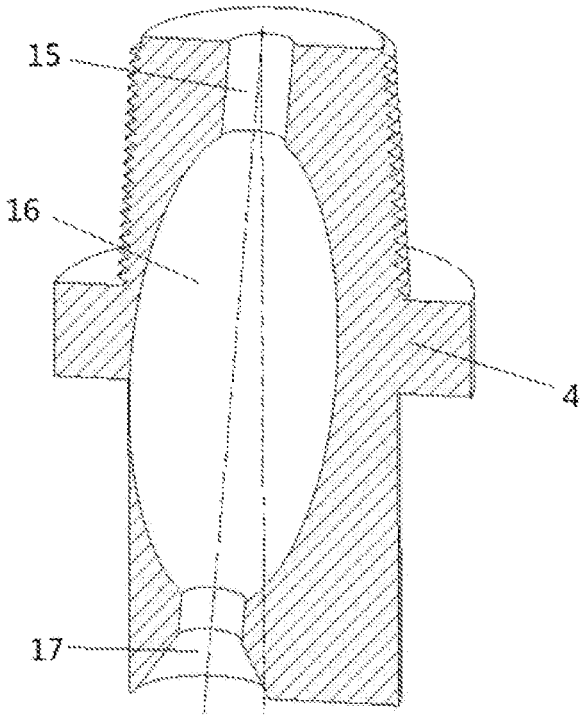
FIG. 5 is a three-dimensional semi-section structure diagram of the nozzle in the present invention.

As shown in FIG. 1 and FIG. 5, the upper end of the nozzle (4) is provided with a male thread, and the upper end of the nozzle (4) is connected with the lower end of the connecting pipe (3) by threads. The nozzle (4) is a self-excited vibration cavitation nozzle, and the internal cavity is divided into a nozzle inlet (15), a cavitation cavity (16) and a nozzle outlet (17). The cavitation cavity (16) is eccentric, wherein an included angle between center lines of the cavitation cavity (16) and the nozzle (4) is 5 to 10 degrees. The cavitation cavity (16) is ellipsoid, and the cross section of the nozzle outlet (17) is a wide-angle fan, covering an angle from 100 to 150 degrees.

As shown in FIG. 1 and FIG. 2, when the electric submersible pump (8) is working, there is a great pressure difference between the outlet of electric submersible pump (8) and the suction port (9), usually reaching 10-15 MPa. When the produced high-pressure fluid enters the pipe string joint (1) via the outlet of electric submersible pump (8), the pressure of the produced high-pressure fluid is greater than the preset pressure of return spring (2) of the check valve (11). After the check valve (11) is opened and the oil drain passage inlet (10) is connected with the oil drain passage outlet (12), the produced high-pressure fluid enters the connecting pipe (3) and finally is ejected from the nozzle (4). The connecting pipe (3) is fixed on the housing of the electric submersible pump (8) by a plurality of retaining rings (7) to maintain the rigidity of the connecting pipe (3) and avoid the vibration or movement of the nozzle (4) in the high-pressure ejection process. The nozzle (4) is provided with an eccentric cavitation cavity (16) and a wide-angle nozzle outlet (17). After the produced high-pressure liquid is ejected, it covers a wide area and can effectively clean the suction port (9) of electric submersible pump.

After the produced high-pressure fluid is ejected from the nozzle (4), it directly acts on the suction port (9) of the electric submersible pump to realize effective plug removal and scale prevention under its jet action, vibration wave and cavitation action. The oscillation and cavitation effects of vibration wave break the medium and long molecular chains of crude oil, reduce the viscosity of crude oil and facilitate the suction of the electric submersible pump (8), making the electric submersible pump (8) more suitable for heavy oil production.

Due to a significant pressure difference between the outlet of the electric submersible pump (8) and the suction port (9), as long as the electric submersible pump (8) works normally, part of the produced high-pressure fluid can be ejected from the nozzle (4) to realize real-time automatic cleaning of the suction port (9). When the electric submersible pump (8) stops, the produced fluid pressure of electric submersible pump (8) drops, and the check valve (11) is automatically closed, so as to avoid the backflow of fluid in the bottom well through the nozzle (4) and the connecting pipe (3).

The discharge flow of pipe string joint (1) accounts for 1%-5% of the outlet flow of the electric submersible pump and the flow of produced high-pressure fluid distributed to the automatic cleaning device for suction port is small, which can effectively ensure that the suction port of the electric submersible pump realizes automatic real-time cleaning, and also does not affect operations of the electric submersible pump. The present invention has no rotating parts and requires no modification to the interior of the electric submersible pump. The pipe string joints of different diameters, connecting pipes of different lengths and nozzles of different diameters are adopted according to the specifications of the electric submersible pump so as to realize the automatic cleaning of suction port of electric submersible pump. The present invention has the advantages of simple structure and wide application range.

The above are not intended to limit the present invention in any form. Although the present invention has been disclosed as above with embodiments, it is not intended to limit the present invention. Those skilled in the art, within the scope of the technical solution of the present invention, can use the disclosed technical content to make a few changes or modify the equivalent embodiment with equivalent changes. Within the scope of the technical solution of the present invention, any simple modification, equivalent change and modification made to the above embodiments according to the technical essence of the present invention are still regarded as a part of the technical solution of the present invention.

What is claimed is:

1. An automatic cleaning device for a suction port of an electric submersible pump, comprising:

a pipe string joint, a plurality of return springs, a plurality of connecting pipes, a nozzle, a plurality of steel balls, a plurality of sealing plugs and a plurality of retaining rings;

wherein the pipe string joint is a hollow cylinder, which includes a female thread disposed at an upper end, a boss disposed in a middle part, and a male thread disposed at a lower end; the upper end of the pipe string joint is connected with an oil pipe by threading, while the lower end of the pipe string joint is connected with an outlet of the electric submersible pump by threading; a plurality of oil drain passage inlets, the plurality of steel balls, the plurality of return springs, the plurality of sealing plugs and a plurality of oil drain passage outlets are evenly distributed in a circumferential direction of the boss;

wherein the boss together with the plurality of steel balls, the plurality of return springs and the plurality of sealing plugs constitute a plurality of check valves; the plurality of sealing plugs are connected with the pipe string joint by threading to realize a thread sealing; when the pipe string joint is filled with high-pressure fluid, the plurality of steel balls compress the plurality of return springs to connect the plurality of oil drain passage inlets and the plurality of oil drain passage outlets; when there is no high-pressure fluid in the pipe string joint, the plurality of return springs are extended and reset to push the plurality of steel balls, thereby realizing a closure between the plurality of oil drain passage inlets and the plurality of oil drain passage outlets;

wherein the plurality of oil drain passage inlets are connected with an inner wall of the pipe string joint, while the plurality of oil drain passage inlets are connected with the plurality of connecting pipes; the plurality of oil drain passage inlets are disposed in a middle part of the boss of the pipe string joint, while the plurality of oil drain passage outlets are disposed below the boss of the pipe string joint and is provided with a female thread;

wherein a connecting pipe of the plurality of connecting pipes is a hollow cylinder, which includes a male thread at an upper end and a female thread at a lower end; the upper end of the connecting pipe is connected with an oil drain passage outlet of the plurality of oil drain passage outlets of the pipe string joint by threading, while the lower end of the connecting pipe is connected with the nozzle by threading;

wherein each of the plurality of retaining rings is a circular ring, which has a plurality of circular holes evenly distributed in a radial direction, an inner wall surface of the retaining ring is fixed with a housing of the electric submersible pump by welding, and the plurality of connecting pipes pass through the plurality of circular holes of the retaining ring and is fixed by welding; the plurality of retaining rings are uniformly welded along an axial direction of the electric submersible pump; the plurality of retaining rings secure the plurality of connecting pipes on the housing of the electric submersible pump;

wherein an upper end of the nozzle is provided with a male thread, and the upper end of the nozzle is connected with the lower end of each of the plurality of connecting pipes by threading; the nozzle is a self-excited vibration cavitation nozzle, and an internal cavity is divided into a nozzle inlet, a cavitation cavity and a nozzle outlet; the cavitation cavity is eccentric, an included angle between center lines of the cavitation cavity and the nozzle is 5 to 10 degrees; the cavitation cavity is ellipsoid, and a cross section of the nozzle outlet is a wide-angle fan, covering an angle from 100 to 150 degrees.

* * * * *